US005558439A

United States Patent [19]

Tilman

[11] Patent Number: 5,558,439

[45] Date of Patent: Sep. 24, 1996

[54] WEDGE ZIPPER

[75] Inventor: Paul A. Tilman, New City, N.Y.

[73] Assignee: Minigrip Inc., Orangeburg, N.Y.

[21] Appl. No.: 488,692

[22] Filed: Jun. 8, 1995

[51] Int. Cl.[6] ..... B65D 33/24

[52] U.S. Cl. ..... 383/63; 24/587

[58] Field of Search ..... 383/63, 107; 24/587; 156/66

[56] References Cited

U.S. PATENT DOCUMENTS

| | | | |
|---|---|---|---|
| 3,416,199 | 12/1968 | Imamura | 383/63 |
| 4,354,541 | 10/1982 | Tilman | 383/63 |
| 4,741,789 | 5/1988 | Zieke et al. | 383/63 X |
| 4,756,414 | 7/1988 | Mott | 383/63 X |
| 5,242,516 | 9/1993 | Custer et al. | 383/63 X |
| 5,368,394 | 11/1994 | Scott et al. | 383/63 |

*Primary Examiner*—Jes F. Pascua

*Attorney, Agent, or Firm*—Kane, Dalsimer, Sullivan, Kurucz, Levy, Eisele and Richard, LLP

[57] ABSTRACT

A reclosable bag is formed of walls defining a closure with a mouth. The closure includes a male profile extending along an internal surface of one of the walls and a female profile adapted to interengage with the male profile and extending along an internal surface of the other wall. The male and female profiles are extruded from a polymeric resin. At least one of the male and female profiles includes at least one rib of another polymeric material coextruded therewith and extending longitudinally therealong. The polymeric material of the rib has a lower melting point than the polymeric material of the profiles, so that it will melt when a side seal is made transversely across the closure and will flow into and caulk any openings remaining after the interlocked profiles have been flattened.

24 Claims, 2 Drawing Sheets

WEDGE ZIPPER

BACKGROUND OF THE INVENTION

1. Field of the Invention

The present invention relates generally to the art of reclosable plastic bags having extruded zippers, and more particularly to the provision of the fastener profiles on such bags with a member comprising a low-melting-point or high-flow polymeric material, said member providing a caulking means at the side seals thereof.

2. Description of the Prior Art

Reclosable bags used, for example, for storing household foodstuffs are typically made of polyethylene. As shown in U.S. Pat. No. 3,416,199 to Imamura, a reclosable bag may be formed of two opposed walls equipped at the mouth with fastener profiles. These profiles include a male profile attached to one wall and a female profile on the other wall. The profiles are shaped so that, when they are aligned and pressed together into an engaging relationship, they form a continuous closure for the bag. The bag may be opened by pulling the walls apart to separate the profiles.

In general, the profiles are designed to provide relatively high resistance to opening from inside the bag while rendering the bag relatively easy to open from the outside. For example, U.S. Pat. No. 5,368,394 to Scott et al. discloses a reclosable bag formed of walls defining a closure with a mouth. The closure includes an asymmetric arrowhead male profile extending along an internal surface of one of the walls and a female profile having stubs adapted to interengage with the male profile and extending along an internal surface of the other wall. Both profiles also include stabilizer wedges on both sides thereof and parallel thereto across the width of the bag. The stabilizer wedges give the zipper formed by the male and female profiles a wide-track feel, and help determine the force required to open the bag both from inside and from outside.

In general, the interlocking zipper profiles for reclosable plastic bags are extruded from low density polyethylene (LDPE). These zipper profiles are usually attached to the polymeric sheet material, from which bags or packages are being produced, on a form-fill-and-seal (FFS) machine, although the zipper profiles may be integrally extruded with the polymeric sheet material.

While most FFS machines are of several specific designs, all comprise a filling tube, about which the bags or packages are formed and through which premeasured amounts of a consumer product, such as a food material, may drop as individual bags or packages are being produced in a sequential fashion. On the FFS machine, polymeric sheet material is directed toward and around the filling tube by means of a forming collar, the two lateral edges thereof being brought together to form a fin extending outward from and longitudinally along the filling tube. The male and female interlocking zipper profiles are usually directed between the two lateral edges and are joined or heat-sealed thereto to form the facing inner portions of the reclosable bag opening.

As bags or packages are being produced and filled in a sequential fashion on an FFS machine, seals are made transversely across the polymeric sheet material and interlocked male and female zipper profiles to form the side seals of individual packages. Because of the bulk of the zipper profiles relative to that of the polymeric sheet material, the zipper profiles require some pre-seal treatment in the location where a side seal is to be made, so that the side seal may be complete and not permit any leakage of the contents of the package. Such pre-seal treatment may include the use of heat stompers (hot anvils which crush the zipper profiles at the location of the side seal to be subsequently made), ultrasonic welders (similar to heat stompers but employing ultrasonic energy), hole punchers (which remove a portion of the zipper profile where the side seal is to be applied), and milling cutters (which abrade away a portion of the zipper profile at the side seal location). The pre-seal treatment permits the cross sealing equipment to make a reasonable seal. Unfortunately, such pre-seal treatment of the zipper profiles does not entirely eliminate the occurrence of leaking packages, or "leakers" and complicates the FFS machine.

The present invention is intended to reduce or eliminate the occurrence of "leakers" by providing at least one of the two profiles being joined with a low-melting-point or high-flow member, which is readily melted when the side seal is being made and which in liquid form flows into and caulks any openings remaining after the zipper profiles have been flattened.

SUMMARY OF THE INVENTION

Accordingly, in its broadest forms, the present invention is a reclosable bag comprising a zipper closure, and the zipper closure itself, wherein the reclosable bag includes a front wall and a rear wall joined to form an enclosure with a mouth defined by wall edges at the top of the bag and a zipper closure for selectively opening and closing the mouth. The zipper closure comprises a male profile extending along an internal surface of the first wall and a female profile adapted to interengage with the male profile and extending along an internal surface of the second wall. The male and female profiles are extruded from a first polymeric resin.

At least one of the male and female profiles includes at least one rib of a second polymeric material coextruded therewith and extending longitudinally therealong. The second polymeric material has a lower melting point than the first polymeric material, and melts when a side seal is made transversely across the zipper closure and flows into and caulks any openings remaining after the interlocked profiles have been flattened.

The present invention will now be described in more complete detail with frequent reference being made to the figures identified below.

BRIEF DESCRIPTION OF THE DRAWINGS

FIG. 4 is a figure similar to FIG. 3, but depicting the rib on the male, rather than the female, profile.

DETAILED DESCRIPTION OF THE PREFERRED EMBODIMENT

Figure 2:
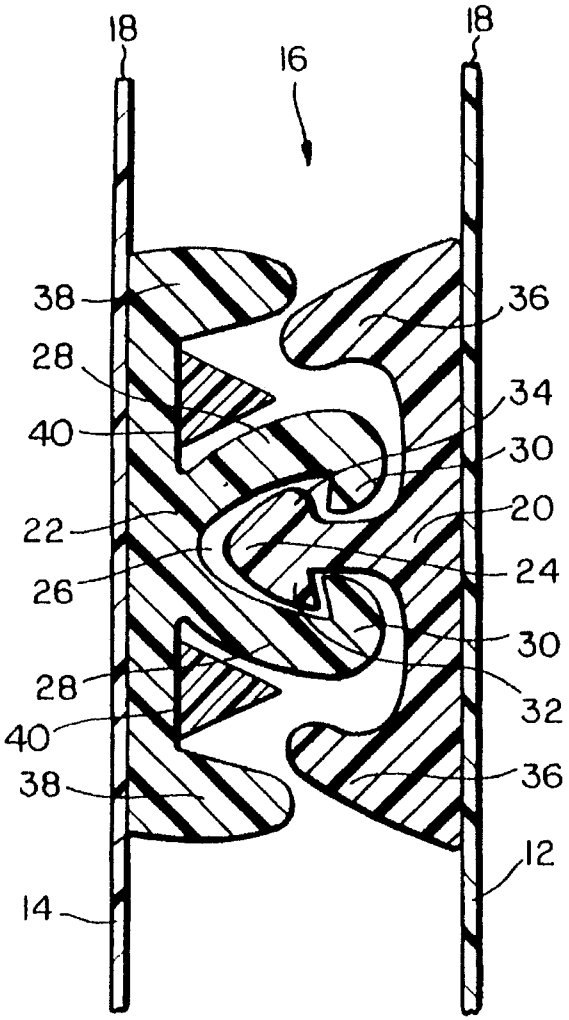
FIG. 2 shows an enlarged side sectional view of the bag opening.
Figure 1:
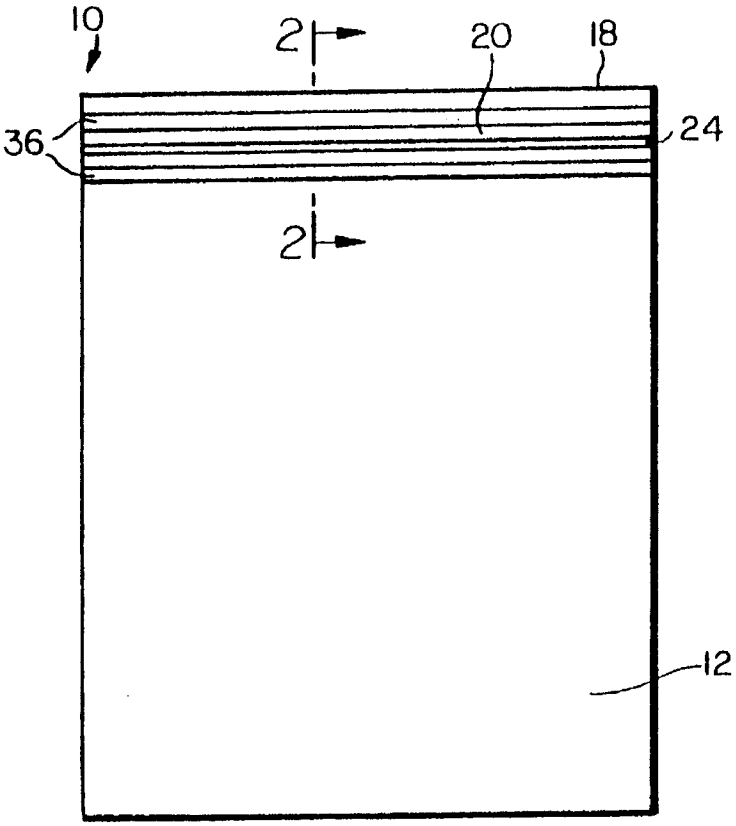
FIG. 1 shows a plan view of a reclosable bag constructed in accordance with the present invention.

Referring now to the drawings, and specifically to FIGS. 1 and 2, a reclosable bag 10 constructed in accordance with the present invention includes front and rear walls 12, 14 joined along three edges thereby forming an enclosure with an opening or mouth 16 along the top of the fourth edge 18. The bag 10 is preferably made of thermoplastic material, such as polyethylene, by extrusion. Attached to the internal faces of walls 12, 14 are male and female profiles 20, 22, respectively, which extend continuously from side to side of the bag. The profiles 20, 22 serve to close the bag opening 16 when they are interlocked as shown in FIG. 2.

The male and female profiles 20, 22 may be as shown in FIG. 2, and it should be understood that the present invention is not intended to be restricted for application only to profiles of the illustrated type. The male profile 20 includes an asymmetric arrowhead 24 which locks into a channel 26 formed by two inwardly curved members 28 having inwardly pointing stubs 30. The asymmetric arrowhead 24 is so called because its two barbs are not mirror images of one another. Barb 32 has an acute edge, while barb 34 has a rounded edge. Barb 34 is closer to the mouth 16 of the bag 10 than barb 32.

The male profile 20 has two stabilizer wedges 36, which are on each side of the asymmetric arrowhead 24 and are parallel thereto across the width of the bag 10. The stabilizer wedges 36 are inclined toward one another and toward asymmetric arrowhead 24, or, at least, have surfaces facing away from the asymmetric arrowhead 24 which are inclined toward one another.

In like manner, the female profile 22 has two stabilizer wedges 38, which are on each side of the inwardly curved members 28 and are parallel thereto across the width of the bag 10. The stabilizer wedges 38 are inclined away from one another, or, at least, have surfaces facing the inwardly curved members 28 which are inclined away from one another.

When the male and female profiles 20, 22 are interengaged as shown in FIG. 2, stabilizer wedges 36 protrude to some preselected degree into the spaces between the stabilizer wedges 38 and the inwardly curved members 28 on the female profile 22.

In accordance with the present invention, the female profile 22 has two internal wedges 40, one of which is between each stabilizer wedge 38 and its neighboring inwardly curved member 28 as shown in FIG. 2, and parallel thereto across the width of the bag 10.

The internal wedges 40 tend to keep the female profile 22 closed by preventing inwardly curved members 28 from unduly separating from one another. More importantly, the internal wedges 40 are coextruded with a low-melting-point or high-flow polymeric material, such as a high-EVA (ethylene vinyl acetate) material, onto the female profile 22. Stabilizer wedges 36 and 38 further act to confine the low melt point wedges 40 within the spaces created by wedges 38 and to direct the low melting point wedges inwardly toward the female profile 22. The material of the internal wedges 40 serves to caulk the spaces between the crushed male and female profiles 20, 22 at the side seams. The Pierce & Stevens E4000 Series of extruded hot melts may be used to provide the internal wedges 40.

Figure 3:
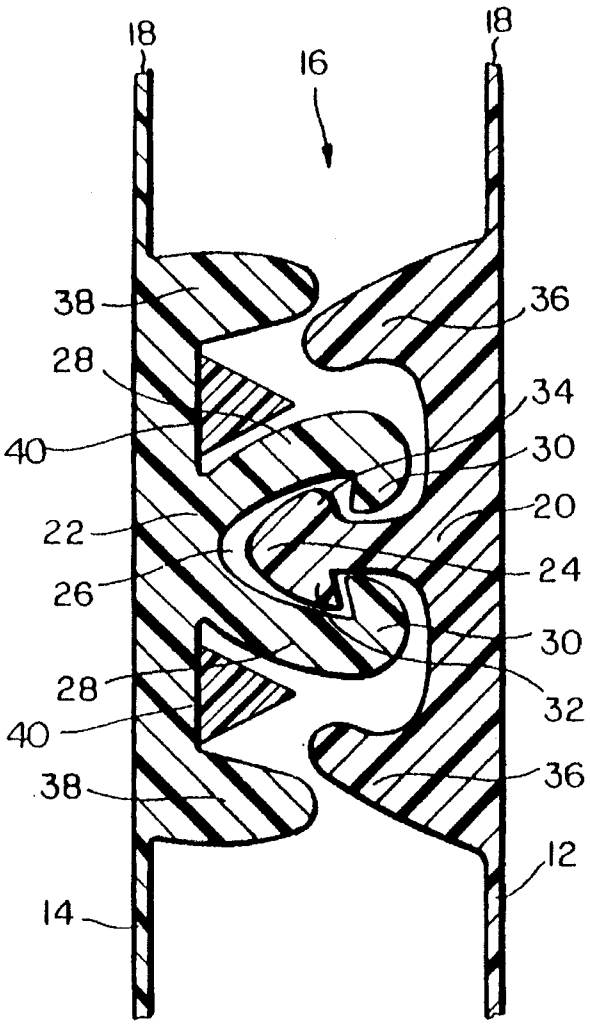
FIG. 3 is a figure similar to FIG. 2, but depicting male and female profiles coextruded with the bag walls.

Bag 10 may be generated unitarily, for example, by extruding the walls 12, 14, and the profiles 20, 22 integrally as shown in FIG. 3. In such case, the internal wedges 40 may again be coextruded with a low-melting-point or high-flow polymeric material, such as a high-EVA material onto the female profile 22. In addition, internal wedges 40*a* may be provided on the male profile, as shown in FIG. 4, rather than internal wedges 40 on the female profile.

It should be understood that the present invention may find application on interlocking zipper profiles of any design, as that shown here is provided as a non-limiting example thereof. Obviously, numerous modifications may be made to this invention without departing from its scope as defined in the appended claims.

What is claimed is:

1. A reclosable bag comprising;

a first wall and a second wall joined to form an enclosure with a mouth defined by wall edges; and a closure for selectively opening and sealing said mouth, said closure comprising a male profile extending along an internal surface of said first wall and a female profile and extending along an internal surface of said second wall, said male and female profiles being extruded from a first polymeric material, wherein at least one of said male profile and said female profile includes at least one rib of a second polymeric material coextruded therewith having a free end directed toward the other of said male profile and said female profile, and extending longitudinally thereal-ong, said second polymeric material having a lower melting point than said first polymeric material.

2. A reclosable bag as claimed in claim 1 wherein said second polymeric material is a low-melting-point material.

3. A reclosable bag as claimed in claim 1 wherein said second polymeric material is a high-flow material.

4. A reclosable bag as claimed in claim 1 wherein said second polymeric material is a high-EVA (ethylene vinyl acetate) material.

5. A reclosable bag as claimed in claim 1 wherein said male profile includes a male interlocking member and a first stabilizer wedge on one side thereof and parallel thereto, and a second stabilizer wedge on the other side thereof and parallel thereto across said bag, wherein said female profile includes a female member adapted to interengage with said male interlocking member and a first stabilizer wedge on one side thereof and parallel thereto, and a second stabilizer wedge on the other side thereof and parallel thereto across the bag, and wherein said at least one rib of a second polymeric material is an internal wedge on one of said male and female profiles.

6. A reclosable bag as claimed in claim 5 wherein said internal wedge is on said female profile between said first stabilizer wedge and said female member.

7. A reclosable bag as claimed in claim 5 wherein said internal wedge is on said female profile between said second stabilizer wedge and said female member.

8. A reclosable bag as claimed in claim 5 wherein said at least one rib of a second polymeric material is two internal wedges on said female profile, one internal wedge being between said first stabilizer wedge and said female member, and the other internal wedge being between said second stabilizer wedge and said female member.

9. A reclosable bag as claimed in claim 5 wherein said internal wedge is on said male profile between said first stabilizer wedge and said male interlocking member.

10. A reclosable bag as claimed in claim 5 wherein said internal wedge is on said male profile between said second stabilizer wedge and said male interlocking member.

11. A reclosable bag as claimed in claim 5 wherein said at least one rib of a second polymeric material is two internal wedges on said male profile, one internal wedge being between said first stabilizer wedge and said male interlocking member, and the other internal wedge being between said second stabilizer wedge and said male interlocking member.

12. A reclosable bag as claimed in claim 1 wherein said male profile is an integral part of said first wall and is coextruded therewith, and said female profile is an integral part of said second wall and is coextruded therewith.

13. A reclosable bag as claimed in claim 1 wherein said male profile is extruded and bonded to said first wall, and said female profile is extruded and bonded to said second wall.

14. A zipper closure for a reclosable bag comprising a male profile and a female profile adapted to interengage therewith, said male and female profiles being extruded from a first polymeric material, wherein at least one of said male profile and said female profile includes at least one rib of a second polymeric material coextruded therewith having a free end directed toward the other of said male profile and said female profile, and extending longitudinally there along, said second polymeric material having a lower melting point than said first polymeric material.

15. A zipper closure as claimed in claim 14 wherein said second polymeric material is a low-melting-point material.

16. A zipper closure as claimed in claim 14 wherein said second polymeric material is a high-flow material.

17. A zipper closure as claimed in claim 14 wherein said second polymeric material is a high-EVA (ethylene vinyl acetate) material.

18. A zipper closure as claimed in claim 14 wherein said male profile includes a male interlocking member and a first stabilizer wedge on one side thereof and parallel thereto, and a second stabilizer wedge on the other side thereof and parallel thereto, wherein said female profile includes a female member adapted to interengage with said male interlocking member and a first stabilizer wedge on one side thereof and parallel thereto, and a second stabilizer wedge on the other side thereof and parallel thereto, and wherein said at least one rib of a second polymeric material is an internal wedge on one of said male and female profiles.

19. A zipper closure as claimed in claim 18 wherein said internal wedge is on said female profile between said first stabilizer wedge and said female member.

20. A zipper closure as claimed in claim 18 wherein said internal wedge is on said female profile between said second stabilizer wedge and said female member.

21. A zipper closure as claimed in claim 18 wherein said at least one rib of a second polymeric material is two internal wedges on said female profile, one internal wedge being between said first stabilizer wedge and said female member, and the other internal wedge being between said second stabilizer wedge and said female member.

22. A zipper closure as claimed in claim 18 wherein said internal wedge is on said male profile between said first stabilizer and said male interlocking member.

23. A zipper closure as claimed in claim 18 wherein said internal wedge is on said male profile between said second stabilizer wedge and said male interlocking member.

24. A zipper closure as claimed in claim 18 wherein said at least one rib of a second polymeric material is two internal wedges on said male profile, one internal wedge being between said first stabilizer wedge and said male interlocking member, and the other internal wedge being between said second stabilizer wedge and said male interlocking member.

* * * * *